US006145657A

United States Patent [19]

Cox

[11] Patent Number: 6,145,657

[45] Date of Patent: Nov. 14, 2000

[54] STORAGE DEVICE FOR A SHAVING RAZOR

[76] Inventor: Jerry Cox, 310 E. 74th St., New York, N.Y. 10021

[21] Appl. No.: 09/439,405

[22] Filed: Nov. 11, 1999

[51] Int. Cl.[7] ..... A45D 27/22

[52] U.S. Cl. ..... 206/208; 206/228

[58] Field of Search ..... 206/15.3, 208, 206/222, 228, 349, 351, 362.3; 30/34.05

[56] References Cited

U.S. PATENT DOCUMENTS

| | | | |
|---|---|---|---|
| D. 258,270 | 2/1981 | Gray | D9/342 |
| 1,189,118 | 6/1916 | Jonas et al. . | |
| 1,912,627 | 6/1933 | Dyer . | |
| 2,027,899 | 1/1936 | Bruce | 206/208 |
| 2,443,495 | 6/1948 | Diaz de Tuesta . | |
| 3,735,860 | 5/1973 | Nissen et al. | 206/228 |
| 3,759,594 | 9/1973 | Cobb | 312/13 |
| 4,198,745 | 4/1980 | Moehlenpah | 30/34 R |
| 5,007,533 | 4/1991 | Purohit . | |
| 5,042,658 | 8/1991 | Tiramani et al. | 206/349 |
| 5,251,752 | 10/1993 | Purohit . | |
| 6,009,622 | 1/2000 | Liedblad | 30/41 |

*Primary Examiner*—David T. Fidei
*Attorney, Agent, or Firm*—Stroock & Stroock & Lavan LLP

[57] ABSTRACT

A housing for a shaving razor with razor blade(s) immersed in oil or another liquid. The housing will be of two elements with no working parts. The primary structure permits a minimal quantity of oil or other liquid to submerge the razor blade element with razor handle upright. It will also feature a catch extension on the back wall to aid oil drainage from the submersed end. The second structure is a frontally mounted lid with razor handle positioned for easy access. The oil is a light viscosity plant derivative such as sunflower oil or peanut oil or other liquids which will not affect the shaving razor's parts or the containment cell and will contain a tocopherol vitamin A stabilizer along with a biocide. To secure the housing in the desired position, a "hook and loop" type attachment device, such as Velcro™, will be provided to allow removal for cleaning.

7 Claims, 3 Drawing Sheets

STORAGE DEVICE FOR A SHAVING RAZOR

BACKGROUND OF THE INVENTION

This invention is directed to a housing for storing a razor, and in particular, to a shaving razor storage device which reduces corrosion to a razor blade housed therein. Since the bronze age, men of many societies have sought to improve their method of removing facial hair with a metal blade. Through that long history of shaving instruments, improvements have focused on blade quality. Better alloys, better handling and control methods and now, multiple blades with separation for better bristle clearance.

As the art graduated to the expediency of the safety razor, the double-edged blade was dominant and gadgetry evolved to produce other symbiotic instruments with balance, weight and esthetic appeal in mind. The single-edge injector razor was the next leap forward as the "disposable" society sought to avoid accidental lacerations. These devices included a handle which included an attaching structure for receiving a disposable blade. The handle may have been made of plastic or metal. The blade was made of metal, but may have been housed in a plastic cartridge. This led to a whole progression of plastic/metal combinations connected to a primary handle to effect utility for travel, variable blade angle, durability and simplicity of use. Most recently, the double-edged razor has evolved into the triple-edged razor.

Alloys of various composition have been created to provide razors with sharper edges to retain that sharpness through innate hardness and resistance to oxidation. Even space-age materials have been adapted which perform better than those previous compositions of high carbon content. However, it is well-known that all metal blades rust and/or corrode as a result of use and exposure to oxygen. It is also known that metal immersed in oil or other such liquids is not subject to corrosive effects of oxygen and though some attempts have been made to apply this fact to shaving implements, such attempts have been impractical or not worth the trouble.

SUMMARY OF THE INVENTION

The present invention consists of a housing to house a razor blade and handle unit which is positioned so that the razor blade may be immersed in oil or a like liquid when not in use. More specifically, the invention is directed to a structure capable of housing a shaving razor such that the razor blade is immersed in oil or a like liquid for the purpose of extending the razor blade serviceability well beyond previous expectations and with convenience and utility that improves on previous art.

The storage device for storing a shaving razor handle and razor blade has a housing having a front wall. The front wall defines in part a housing opening for receiving said shaving razor handle and razor blade. A liquid storage well formed within the housing is capable of storing liquid and receiving said razor blade therein. A front lip is formed on the front wall for supporting the razor handle. A handle slot is disposed in the housing for receiving the shaving razor handle and for allowing the razor blade to be positioned in the liquid storage well. The housing opening allows the handle to pivot between a first position in the slot to a second position in the housing opening. A razor blade catch member disposed internally of the housing between the handle slot and liquid storage well engages the razor blade and positions the razor blade above the liquid storage well when the handle is in the second position.

In an exemplary embodiment, the housing may be fabricated of an oil compatible material such as high-impact molded plastic for lighter weight. The liquid disposed in the housing may contain an oil or such liquid which will not degrade the housing. It is preferred that the oil or such liquid will be as tasteless, odorless and colorless as possible and not be capable of affecting the razor support material or the housing.

In an exemplary embodiment the housing may be easily mounted in a medicine cabinet or on the wall and will have a pivotally attached lid. A hinged lid may be provided in the case of outside-cabinet location.

It is, therefore, an object of this invention to create an environment for a razor and blade material which will extend the period of its effective use.

It is another object to provide a neat and sanitary environment for a razor between shaves.

It is also an object of the present invention to effectively reduce the number of razor blades thrown-away in a given period of time.

Still other objects and advantages of the invention will in part be obvious and will in part be apparent from the specifications.

It will thus be seen that the objects set forth above, and those made apparent from the preceding description, are efficiently attained and, because certain charges may be made in the above construction without departing from the spirit and scope of the invention, it is intended that all matter contained in the above description, and as shown in the accompanying drawings, shall be interpreted as illustrations and not in a limiting sense.

The invention accordingly comprises the features of construction, combination of elements, and arrangement of parts which will be exemplified in the constructions hereinafter set forth and the scope of the invention will be indicated in the claims.

BRIEF DESCRIPTION OF DRAWINGS

For a fuller understanding of the invention, reference is availed to the following descriptions made in connection with accompanying drawings.

DETAILED DESCRIPTION OF THE PREFERRED EMBODIMENT

Figure 1:
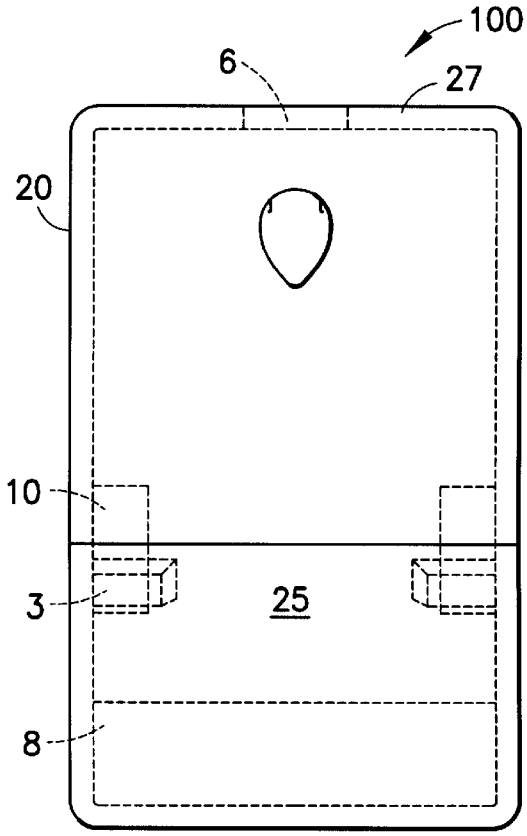
FIG. 1 is a front elevation view of the housing of the present invention showing internal structural features in phantom.
Figure 2:
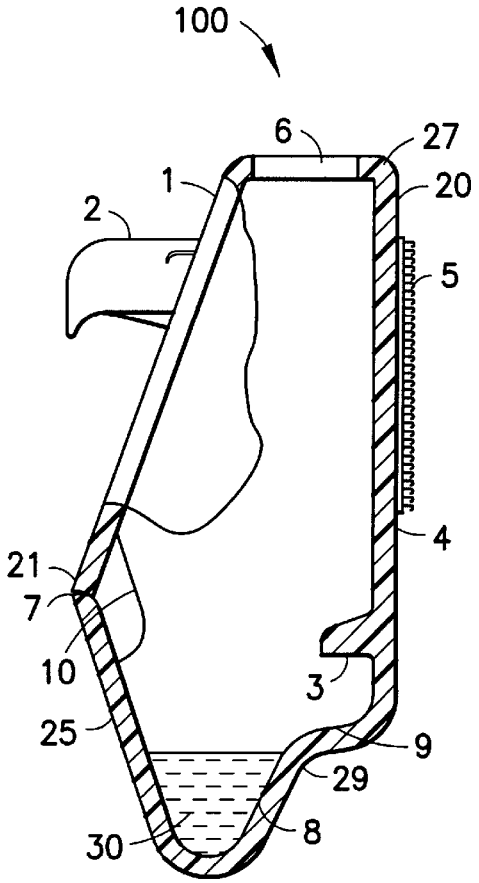
FIG. 2 is a cross-sectional view of the housing of the present invention.

Reference is made to FIGS. 1–6 in which a device for storing a razor, generally indicated as 100, is provided. The device 100 includes a housing 20. Housing 20 includes a roof 27 and a front wall 25 having a lip 7. An opening is formed between front wall 25 and a roof 27. A back wall 4 and bottom 29 complete housing 20. Housing 20 also includes a liquid storage well 8 for storing liquids such as oil or other types of solutions. The liquid storage well 8, according to the preferred embodiment, has a shape and capacity which will allow a razor blade to be easily positioned within the liquid storage well 8. In addition, it is preferable to shape the liquid storage well 8 so that it may be easily cleaned.

As shown in FIG. 1, a detachable lid 1 is provided to allow easy access to the interior of housing 20 to insert and remove a shaver 13 through an opening 23. In the preferred embodiment, lid 1 has a lift handle 2, or the like, to allow one to easily and quickly open and close lid 1. Also, lid 1 may have legs 10 disposed at either side thereof. These legs 10 are attached to the housing 20 at the interior of front wall 25 in such a manner as to permit firm seating of lid 1 while allowing easy removal of the same. In addition, the lower edge 21 of lid 1 may be shaped to match that of the front lip 7 of front wall 25.

In a preferred embodiment, housing 20 may be made of a durable material or a high-impact plastic to accommodate repeated usage. It is preferred that housing 20 be made of a lightweight material. Additionally, it is desirable to form housing 20 from a smoky gray material that is about 30% in value gradient, for example, since this would allow inspection of the oil/solution level, the presence of hair residue, and the like.

A handle slot 6 capable of receiving a razor handle is formed in roof 27. In the preferred embodiment, the handle slot 6 is a centered slot as shown in FIG. 1.

Lastly, a razor blade catch member 3 extends from back wall 4 into the interior of housing 12 and, in an exemplary embodiment, in the general direction of wall 25. The razor blade catch member 3 has an underside extending outward from back wall 4 and, by way of example, beveled downward at a 15 degree angle. The razor blade catch member 3 is outwardly extended sufficiently to support a razor blade 11 and razor handle 12 of shaver 13 without damage at entry or extraction.

The housing 20 of the preferred embodiment need not be airtight, but should be atmospherically discreet. This would thus allow for simple access to the razor blade 11 and razor handle 12 of a shaver 13 with minimal air exchange. It should be noted that this invention may evolve into gift versions of a more elaborate nature, i.e. the old fashioned shaving cups of yore and present shaving kits.

Figure 3:
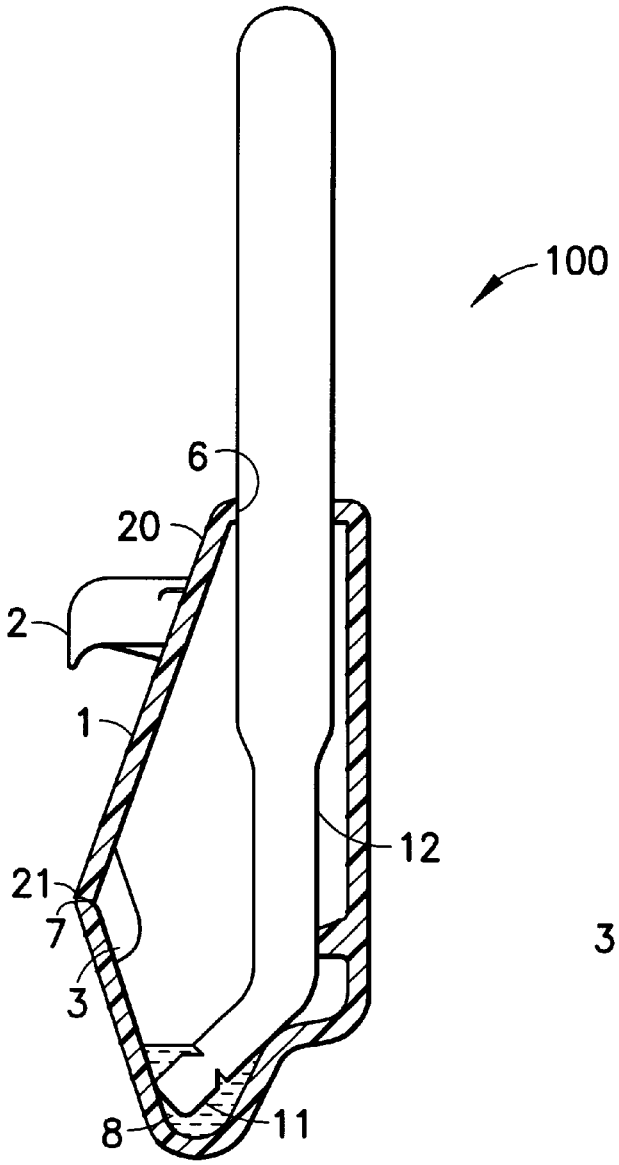
FIG. 3 is a side sectional view of the housing showing a razor housed therein.

During use shaver 13 is placed in housing 20 so that razor blade 11 is disposed in well 8 and oriented so that handle 12 is received in slot 6 of roof 27. An oil 30, or some other antioxidant is disposed in well 8 at least at a level such that razor blade 11 displaces a sufficient volume of oil 30 to envelope razor blade 11 (FIG. 3). The oil 30 preferably has a plant derivative with tocopherol vitamin E as an antioxidant stabilizer. It may also contain a minute but effective amount of biocide. Lid 1 is placed over opening 23 sealing shaver 13 therein, further protecting it from dirt and oxidation. When a user is ready to use the razor 13, the user may use the lift handle 2 to open the lid 1 in order to access the razor handle 12.

Figure 5:
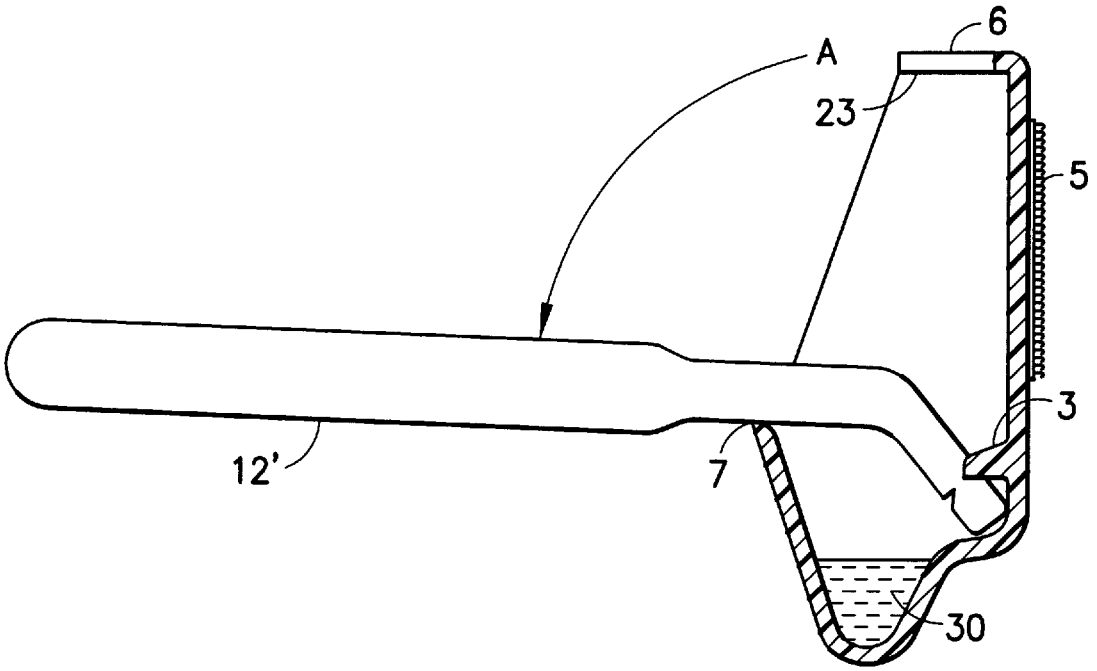
FIG. 5 is a side sectional view of the housing shown in FIG. 3 with the razor shown in drain position.

Referring now to FIG. 5, the razor handle 12 can be removed from slot 6 and rotated in the direction of an arrow A, as shown, into position on a front lip 7. In this position, the razor blade 11 engages razor blade catch member 3. Because the center of gravity of shaver 13 is outside of housing 20, gravity causes razor blade 11 to be held against razor blade catch member 3. This position, hereinafter known as the drain position, allows any oil or solution contained on the razor blade 11 to be drained so that the oil 30 or other such solution collects in the liquid storage well 8. The front lip 7 of the preferred embodiment will be beveled to minimize wear to the razor in the drain position as well as accommodate razors of different drain angles. Once sufficiently drained, the shaver 13 is ready to be used for shaving. Of course, one may shave prior to having the razor blade 11 drained, but such draining is preferred. If, for example, sunflower oil is the oil 30 in which razor blade 11 is stored, it has been determined by testing that no more than 5 seconds is required for sunflower oil to be drained from razor blade 11. Of course, different types of solutions will have different drainage rates.

The device 100 not only provides for convenient storage and access to shaver 13 while extending blade serviceability, but also provides a better cost amortization. The cost may be as little as 1.5 cents per shave or approximately on-fifth of present usage.

It is noted that the razor blade 11 can be a single blade razor, a double blade razor or a triple blade razor as well as any other razor blade that is or will be commercially available.

An attachment member 5 may be used to attach the housing 20 to a medicine cabinet or on a wall. Attachment member 5 may be user applied and can be one of many dimensions sufficient to support housing 20. In the preferred embodiment, the attachment member 5 is marine quality "hook and loop" type attachment device, such as Velcro™. This will allow for the housing 20 to resist lateral and vertical stress while permitting removal for occasional cleaning. Additionally, the housing 20 can be easily mounted and remounted.

Figure 4:
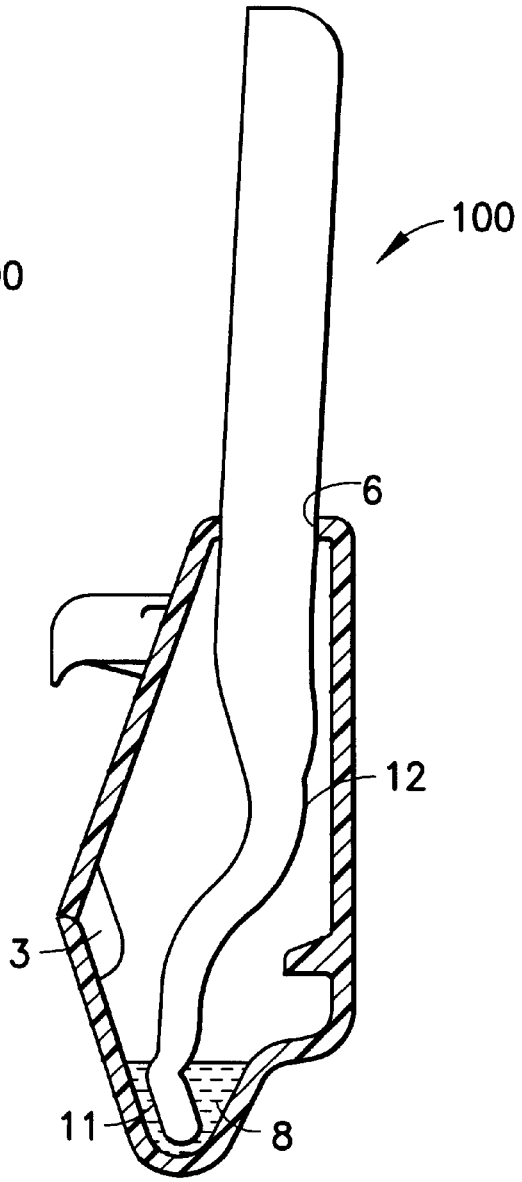
FIG. 4 is a side sectional view of the housing showing a second razor housed therein.
Figure 6:
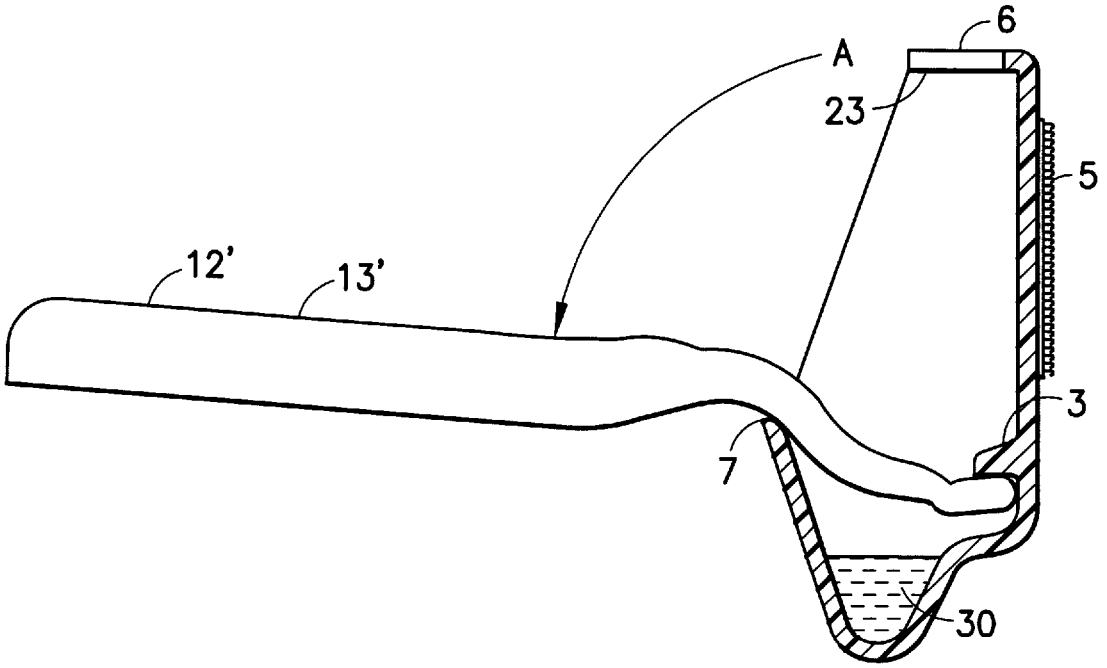
FIG. 6 is a side sectional view of the housing shown in FIG. 4 with the second razor shown in drain position.

The present invention was described with specific reference to razor 13 in FIGS. 3 and 5. However, as shown in FIGS. 4 and 6, the invention can also accommodate different shaped razors 13'. Each razor 13' has its handle 12' with its blade 11' oriented so as to be immersed in an oil 30 or other like liquid solution. In the preferred embodiment, the housing 20 is adaptable to be easily mounted inside or outside bathroom cabinetry and to be durable, functional and esthetically agreeable.

It will thus be seen that the objects set forth above, among those made apparent from the preceding description, are efficiently attained and, since certain changes may be made in the above construction without departing from the spirit and scope of the invention, it is intended that all mater contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall there between.

What is claimed is:

1. A storage device for storing a shaving razor handle and razor blade comprising:

a housing having a front wall defining in part a housing opening on the front side of said housing for receiving said shaving razor handle and razor blade;

a liquid storage well formed within said housing and capable of storing liquid and receiving said razor blade therein;

a front lip formed on said front wall for supporting said razor handle;

a handle slot disposed in said housing for receiving said shaving razor handle and for allowing said razor blade to be positioned in said liquid storage well, said housing opening allowing said handle to pivot between a first position in said slot to a second position in said housing opening; and a razor blade catch member disposed internally of said housing between said handle slot and liquid storage well to engage said razor blade and to position said razor blade above said liquid storage well when said handle is in said second position.

2. A storage device according to claim 1 further comprising a lid positioned over said housing opening and said lid is pivotally attached to said housing.

3. A storage device according to claim 2 further comprising a handle integrally formed with said lid.

4. A storage device according to claim 1 wherein said housing includes a back wall, and said razor blade catch device extends from said back side of said housing at a downward angle of substantially 15% relative to said back wall.

5. A storage device according to claim 1 further comprising an attachment member for attaching an external surface of said housing to a surface.

6. A storage device according to claim 5 wherein said housing has a rear wall and said attachment member further comprises a hook and loop fastener, said attachment member is positioned between said rear wall and said surface, allowing said housing to easily be removed from said surface.

7. A storage device according to claim 2 wherein said lid has legs integrally formed with said lid and said legs are attachable to said front wall.

* * * * *